US008249288B2

(12) United States Patent
Xu

(10) Patent No.: US 8,249,288 B2
(45) Date of Patent: Aug. 21, 2012

(54) EARPHONE WITH ADJUSTIBLE PLUG

(75) Inventor: Bao-Qin Xu, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 343 days.

(21) Appl. No.: 12/696,009

(22) Filed: Jan. 28, 2010

(65) Prior Publication Data

US 2010/0239116 A1 Sep. 23, 2010

(30) Foreign Application Priority Data

Mar. 21, 2009 (CN) ..... 2009 1 0301022

(51) Int. Cl.
*H04R 25/00* (2006.01)

(52) U.S. Cl. ..... 381/384; 381/370

(58) Field of Classification Search ..... 381/370, 381/384

See application file for complete search history.

(56) References Cited

U.S. PATENT DOCUMENTS

2001/0053228 A1* 12/2001 Jones ..... 381/71.6

* cited by examiner

*Primary Examiner* — Yuwen Pan
*Assistant Examiner* — Matthew Eason
(74) *Attorney, Agent, or Firm* — Altis Law Group, Inc.

(57) ABSTRACT

An earphone comprises two headphones, a plug assembly and a wire electronically connected to the headphones and the plug assembly. The plug assembly comprises a main pole, a first plug set in one end of the main pole and electronically connected to the wire, a sleeve placed over the first plug, and an adjusting wheel screwed on the main pole. The adjusting wheel is configured for driving the main pole to move when receiving an exterior force, thereby driving the first tube body to extend out of the sleeve or receive into the sleeve.

15 Claims, 5 Drawing Sheets

EARPHONE WITH ADJUSTIBLE PLUG

BACKGROUND

1. Technical Field

The present disclosure relates to an earphone with an adjustable plug.

2. Description of Related Art

Generally, there are two different earphone sizes depending on the device that uses them, 3.5 mm and 2.5 mm. When users want to switch listening from one device to another device they may need to switch earphones as well.

Therefore, what is needed is an earphone plug to overcome the described shortcoming.

DETAILED DESCRIPTION

Figure 1:
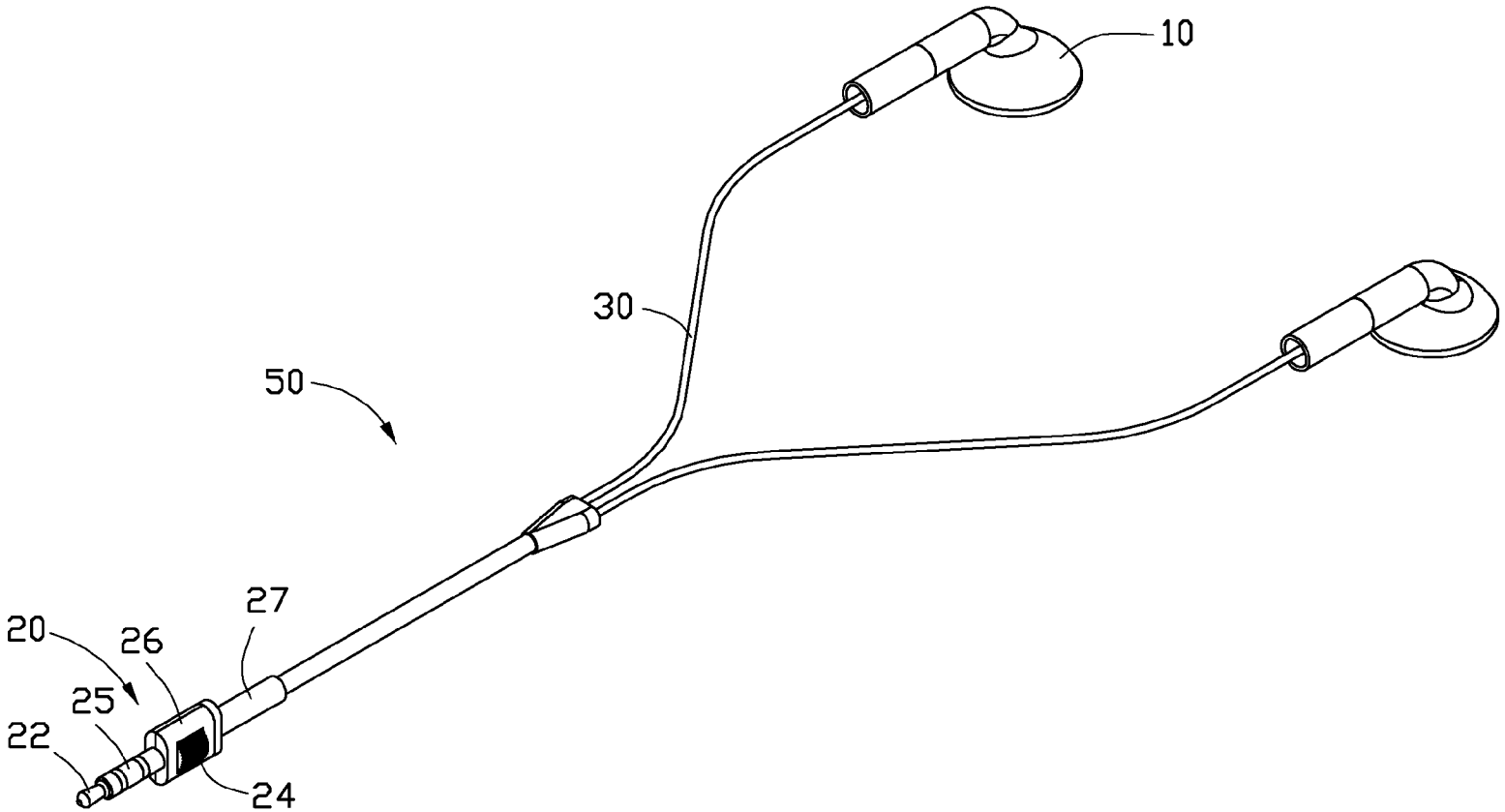
FIG. 1 is an isometric view of an earphone in a functional state in accordance with an exemplary embodiment.

Referring to FIG. 1, an earphone 50 is provided. The earphone 50 includes two headphones 10, a plug assembly 20, and a wire 30 connecting the headphones 10 to the plug assembly 20.

Figure 2:
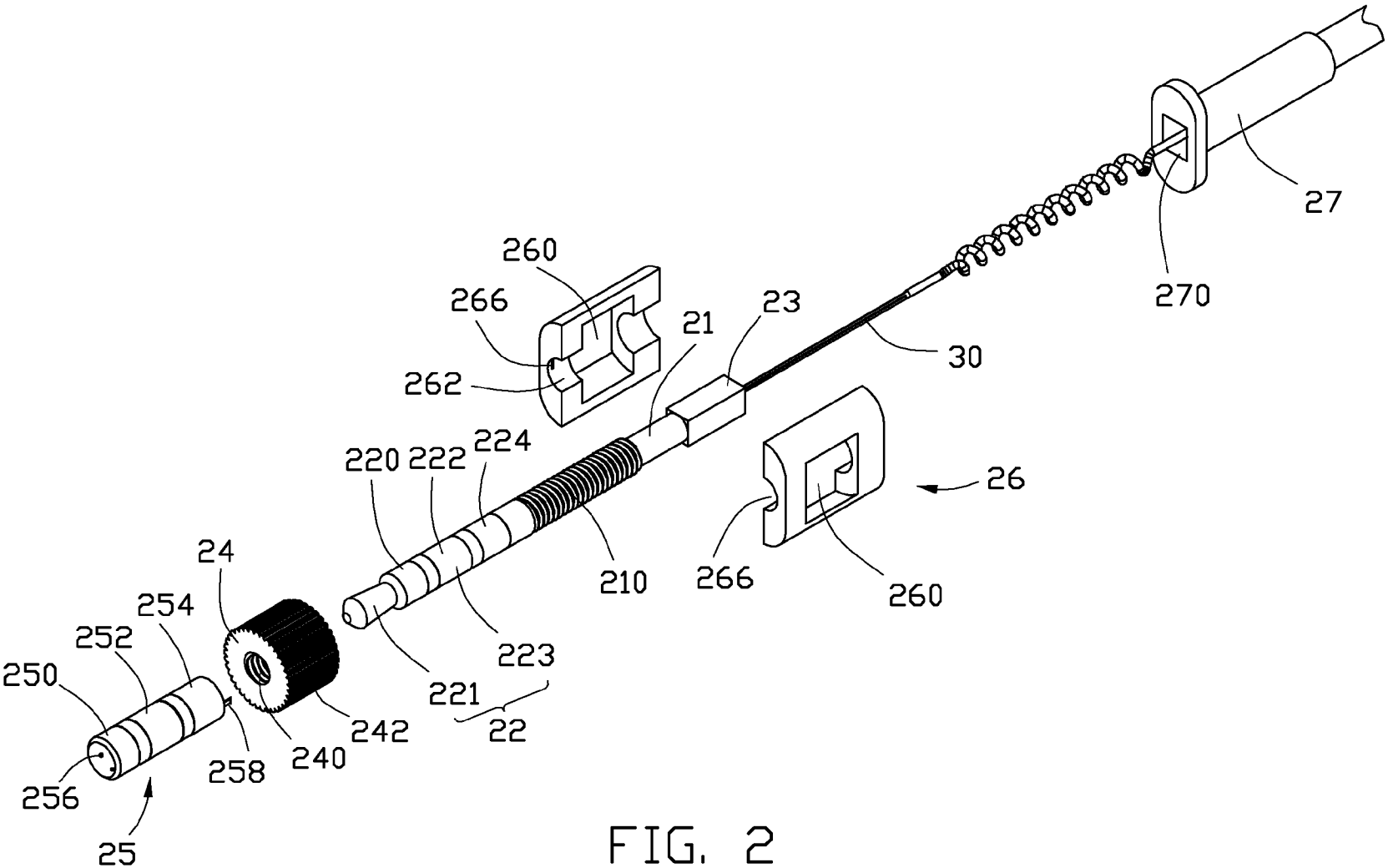
FIG. 2 is an exploded view of a plug assembly of the earphone in FIG. 1.
Figure 3:
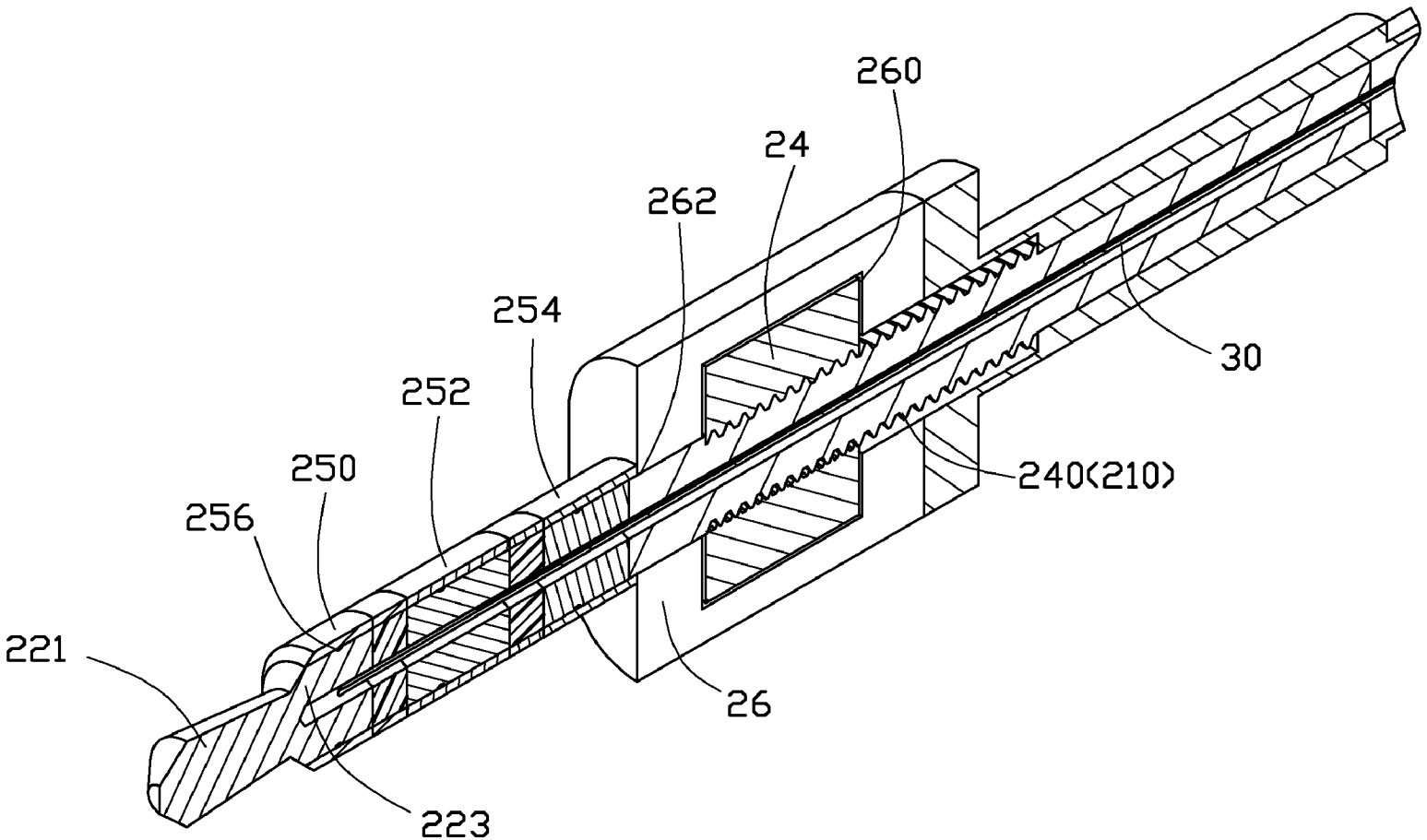
FIG. 3 is a cutaway view of the earphone of FIG. 1.

Referring to FIGS. 2-3, the plug assembly 20 includes a telescoping main pole 21, a first plug 22, a stopping block 23 opposite to the first plug 22, a sleeve 25 placed over the first plug 22, an adjusting wheel 24 screwed on the main pole 21, a housing 26 placed over the main pole 21, and a receiving conduit 27 fixedly connected to the housing 26. The first plug 22 and the stopping block 23 are set in opposite ends of the main pole 21. The housing 26 is configured for receiving the sleeve 25. The receiving conduit 27 is configured for receiving the stopping block 23. The adjusting wheel 24 is configured to adjust the main pole 21, thereby moving the first plug 22 relative to the sleeve 25.

The first plug 22 includes a head portion 221 and a first tube body 223. One end of the head portion 221 is tapered, and another end of the head portion 21 is connected to the first tube body 223. The outer diameter of the first tube body 223 is 2.5 mm. A left channel contact portion 220, a right channel contact portion 222, and a grounding contact portion 224 are set in the tube body 223 in turn.

The sleeve 25 is a hollow second tube body. The outer diameter of the sleeve 25 is 3.5 mm, and the inner diameter of the sleeve 25 exceeds 2.5 mm. The sleeve 25 is placed over the first tube body 223 of the first plug 22. The length of the sleeve 25 approximately equals to that of the first tube body 223. A second left channel contact portion 250, a second right channel contact portion 252, and a second grounding contact portion 254 are set in the sleeve 25 in turn, and correspond to the first left channel contact portion 220, the first right channel contact portion 222, and the first grounding contact portion 224 respectively. A plurality of protrusions 256 is protruded from the inside surface of the second left channel contact portion 250, the second right channel contact portion 252, and the second grounding contact portion 254 respectively. When the sleeve 25 is completely placed over the first tube body 223, the protrusions 256 resist the outside surface of the first left channel contact portion 220, the first right channel contact portion 222, and the first grounding contact portion 224 respectively, so that, the first left channel contact portion 220 is electronically connected to the second left channel contact portion 250, the first right channel contact portion 222 is electronically connected to the second right channel contact portion 252, and the first grounding contact portion 224 is electronically connected to the second grounding contact portion 254. Two hook portions 258 are extended from one end of the sleeve 25 adjacent to the second grounding contact portion 254.

Figure 4:
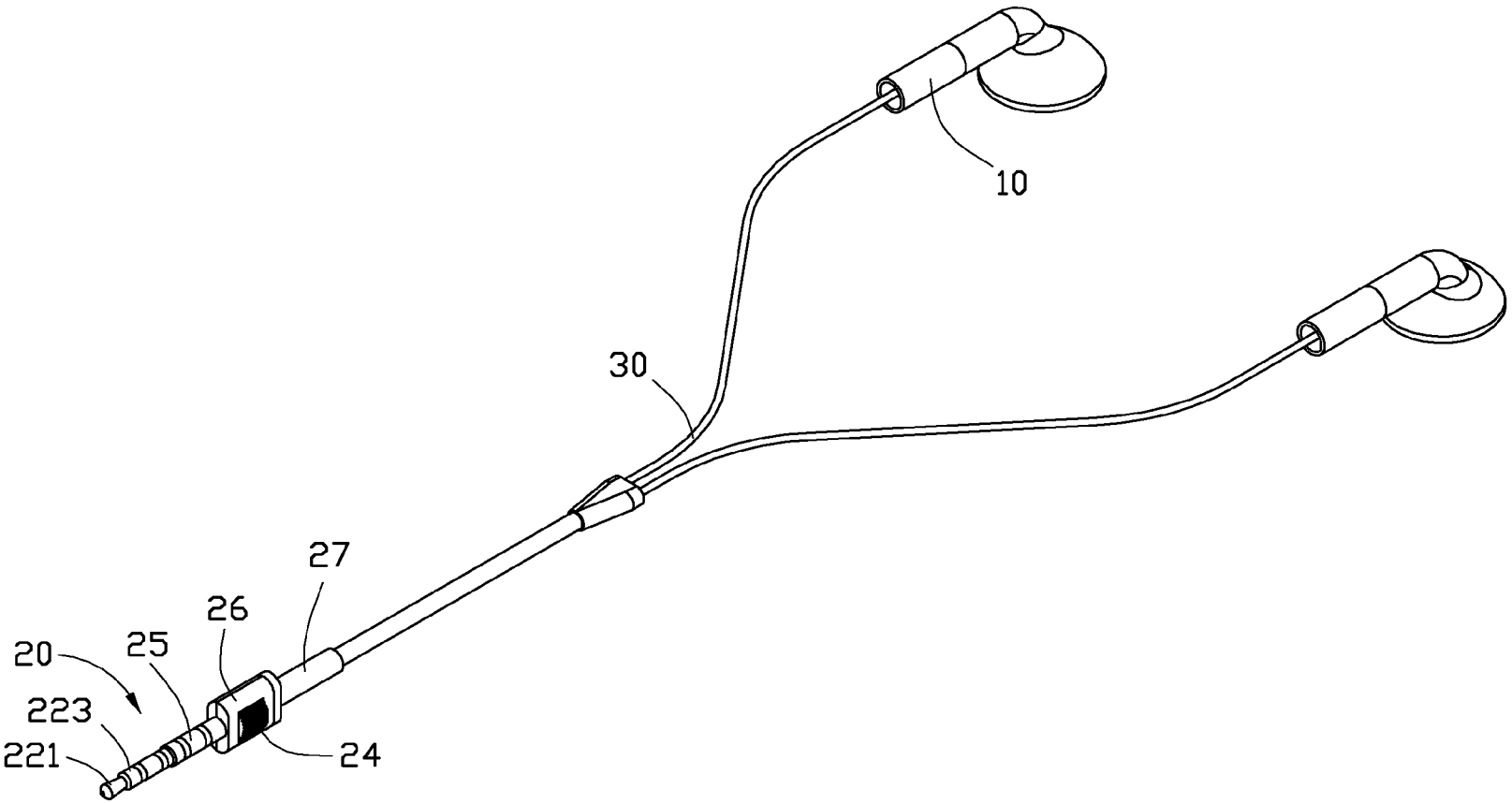
FIG. 4 is an isometric view of the earphone of FIG. 1, in another functional state.
Figure 5:
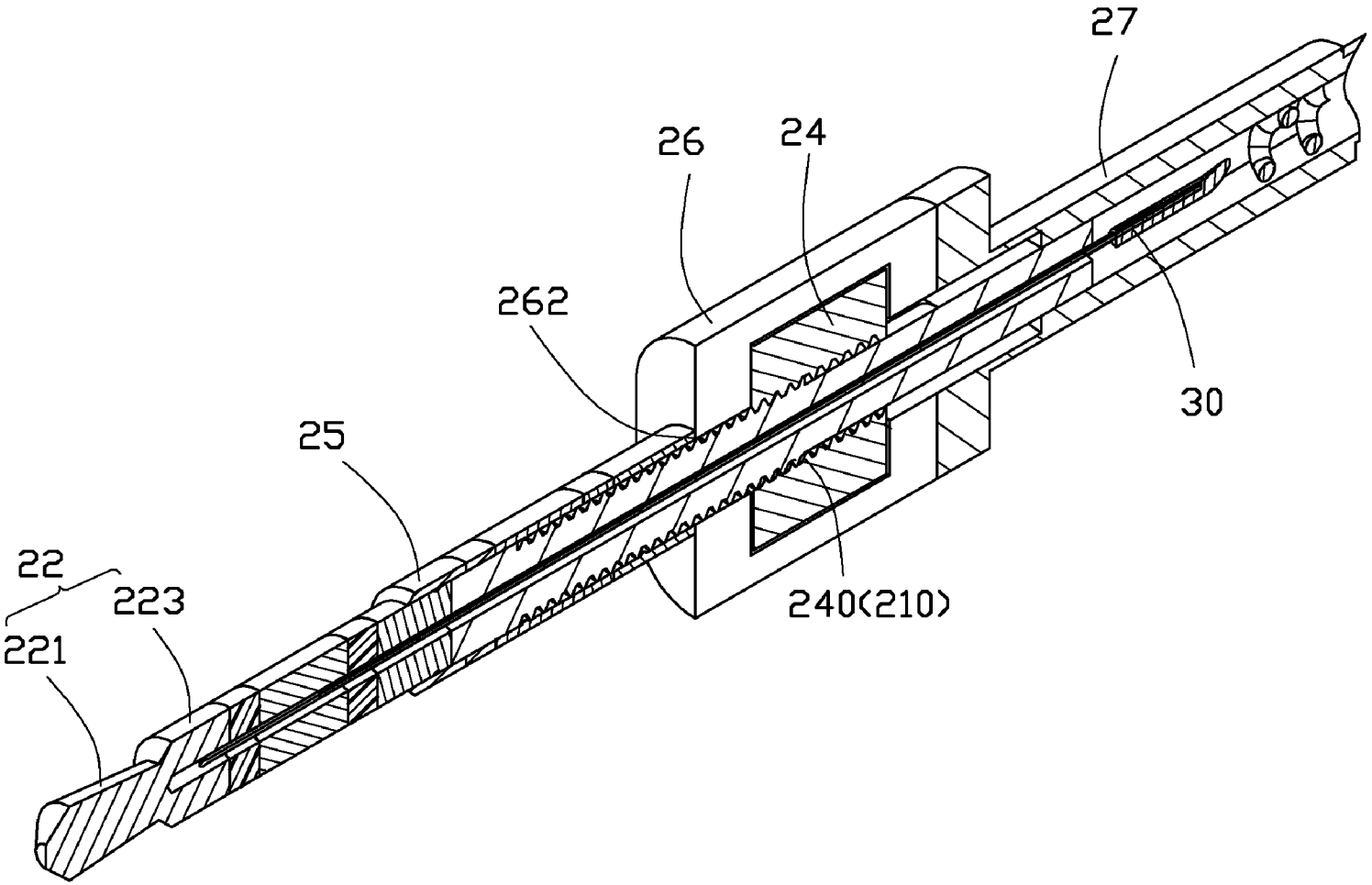
FIG. 5 is a cutaway view of the earphone plug of FIG. 4.

Referring to FIGS. 4-5, a portion 210 of the main pole 21 away from the stopping block 23 is a threaded pole. The adjusting wheel 24 is a cylinder canister, and includes a threaded inside surface 240 and a grooved outside surface 242. The grooves (not labeled) in the outer surface allow for a better grip by the user when manipulating the adjusting wheel 24. The length of the threaded main pole 210 exceeds or equals to that of the sleeve 25.

The housing 26 is substantially elliptical in cross-section. A receiving space 260 is defined within the housing 26 and a circular hole 262 coaxial to the receiving space 260 is bored through the housing 26 longitudinally from end to end. The main pole 21 is passed through the housing 26 by way of the hole 262, and the sleeve 25 is fixed to the housing 26 with the two hook portions 258. The adjusting wheel 24 is received into the housing 25 snuggly fitting into the receiving space 260. The two opposite portions of the grooved outside surface 242 of the adjusting wheel 24 are exposed, while the adjusting wheel 24 being fixed in the housing 26, assuring no movement along the axis of the main pole 21. Two chambers 266 are defined in one end of the housing 26 adjacent to the sleeve 25. Two hook portions 258 are engaged with the two chambers 266, thereby securing the two hook portions 258 to the housing 26.

The stopping block 23 is cuboid, and is located at the end of the housing 26 away from the sleeve 25. The receiving conduit 27 is fixed to one side of the housing 26 adjacent to the stopping block 23. A square receiving chamber 270 is defined in the inside of the receiving conduit 27, and whose shape matches the shape of the stopping block 23, so that the stopping block 23 is slidably received into the receiving conduit 27. The length of the receiving chamber 270 exceeds that of the sleeve 25, and the largest distance of the movement of the stopping block 23 in the receiving conduit 27 equals the length of the sleeve 25.

When the adjusting wheel 24 is rotated by an exterior force, the threaded inside surface of the adjusting wheel 24 cooperates with the threaded main pole 210 to drive the main pole 21 to rotate and move along an axial direction of the main pole 21. Simultaneously, because the threaded main pole 210 is as long as, or longer than, the sleeve 25, and the longest distance of the movement of the stopping block 23 in the receiving chamber 270 equals to the length of the sleeve 25, the distance of movement of the main pole 21 equals the length of the sleeve 25, and the first plug 22 is extended out of the sleeve 25, and the first plug 22 can be inserted into a jack whose outer diameter is 2.5 mm. In addition, the two hook portions 258 cooperate with the two chambers 266 to stop the sleeve 25 from sliding away from the housing 26.

The wire 30 is passed through the receiving conduit 27 and the main pole 21 in turn, and connects to the first plug 22. A portion of the wire 30, is twistable shaped and is received in the receiving conduit 27. When the first plug 22 is adjusted to extend out of the sleeve 25 by the movement of the main pole 21, the wire 30 is stretched, thereby maintaining connection.

For better understanding of the disclosure, the following is a detailed description about a process of using the earphone 50.

When users want to insert the earphone 50 into a jack whose diameter is 2.5 mm, the users rotates the adjusting wheel 24 to drive the main pole 21 to move along an axial direction away from the receiving conduit 27, until the stopping block 23 is resisted by the housing 26, and the main pole 21 stops to move. Herein, the first plug 22 is completely extended out of the sleeve 25, and can be inserted into a jack whose diameter is 2.5 mm.

When users want to insert the earphone 50 into a jack whose diameter is 3.5 mm, the users rotates the adjusting wheel 24 to drive the main pole 21 to move along an axial direction adjacent to the receiving conduit 27, until the stopping block 23 is resisted by the receiving conduit 27, and the main pole 21 stops to move. Herein, the first tube body 223 of the first plug 22 is completely received into the sleeve 25, and can be inserted into a jack whose diameter is 3.5 mm.

Although the present disclosure has been specifically described on the basis of the embodiments thereof, the disclosure is not to be construed as being limited thereto. Various changes or modifications may be made to the embodiments without departing from the scope and spirit of the disclosure.

What is claimed is:

1. An earphone comprising:

two headphones;

a plug assembly; and a wire connecting to the headphones and the plug assembly;

wherein, the plug assembly comprises a main pole, a first plug comprising a head portion and a first tube body connecting to the head portion, set at one end of the main pole and electronically connected to the wire, a sleeve operable to cover the first plug, and an adjusting wheel screwed on the main pole;

wherein, a first left channel contact portion, a first right channel contact portion, and a first grounding contact portion are set in the first tube body in turn, and a second left channel contact portion, a second right channel contact portion, and a second grounding contact portion, corresponding to the first left channel contact portion, the first right channel contact portion, and the first grounding contact portion, respectively, are set in the sleeve in turn, and are operable to electronically connect to the first left channel contact portion, the first right channel contact portion, and the first grounding contact portion respectively when the sleeve covers the first tube body;

wherein, the adjusting wheel is configured for driving the main pole to move when receiving an exterior force, thereby driving the first plug to extend out of the sleeve or receive into the sleeve.

2. The earphone as described in claim 1, wherein a plurality of protrusions is protruded from the inside surface of the sleeve corresponding to the second left channel contact portion, the second right channel contact portion, and the second grounding contact portion, respectively, and when the sleeve covers the first tube body, the protrusions resists the outside surface of the first left channel contact portion, the first right channel contact portion, and the first grounding contact portion respectively to electronically connect the sleeve with the first tube body.

3. The earphone as described in claim 1, wherein the plug assembly further comprises a housing placed over the main pole, a receiving space is defined within the housing, and a through hole is bored through the housing from end to end, the main pole is passed through the housing by way of the through hole, and the adjusting wheel is received into the housing snuggly fitting into the receiving space.

4. The earphone as described in claim 3, wherein two hook portions are extended from one end of the sleeve adjacent to the second grounding contact portion, and two chambers are defined in one end of the housing, and the two hook portions are engaged with the two chambers, thus securing the two hook portions to the housing.

5. The earphone as described in claim 3, wherein a stopping block is set in one end of the main pole opposite to the first plug, the earphone further comprises a receiving conduit fixedly connected to the housing, the receiving conduit is located in one side of the housing away from the sleeve, and a receiving chamber is defined in the receiving conduit, and the stopping block is slidable in the receiving chamber.

6. The earphone as described in claim 5, wherein the length of the receiving chamber exceeds that of the sleeve, and the longest distance of the movement of the stopping block in the receiving chamber equals to the length of the sleeve.

7. The earphone as described in claim 1, wherein the outer diameter of the first tube body is 2.5 mm, and the outer diameter of the sleeve is 3.5 mm.

8. An earphone with two earphone specifications comprising:

two headphones;

a plug assembly; and a wire connecting to the headphones and the plug assembly;

wherein, the plug assembly comprises a head portion, a first tube body, a second tube body and a driving device;

wherein, the outer diameter of the first tube body is a first earphone specification, and the outer diameter of the second tube body is a second earphone specification, the head portion is fixed to one end of the first tube body, and the second tube body is placed over the first tube body, and is configured for moving relative to the first tube body by the driving device, thereby driving the first tube body to extend out of the second tube body or receive into the second tube body.

9. The earphone as described in claim 8, wherein a first left channel contact portion, a first right channel contact portion, and a first grounding contact portion are set in the first tube body in turn, and a second left channel contact portion, a second right channel contact portion, and a second grounding contact portion, corresponding to the first left channel contact portion, the first right channel contact portion, and the first grounding contact portion, respectively, are set in the second tube body in turn, and a plurality of protrusions is protruded from the inside surface of the second left channel contact portion, the second right channel contact portion, and the second grounding contact portion respectively, when the second tube body covers the first tube body, the protrusions resists the outside surface of the first left channel contact portion, the first right channel contact portion, and the first grounding contact portion respectively to electronically connect the second tube body with the first tube body.

10. The earphone as described in claim 8, wherein the plug assembly further comprises a main pole fixedly connected to the first tube body, an adjusting wheel screwed on the main pole, a housing fixedly connected to the second tube body, and portion of the adjusting wheel is received into the housing, and is configured for rotating in the housing to drive the main pole to move when receiving an exterior force, thereby driving the second tube body to move relative to the first tube body.

11. The earphone as described in claim 9, wherein the plug assembly further comprises a housing placed over the main pole, a receiving space is defined within the housing, and a through hole is bored through the housing from end to end, the main pole is passed through the housing by way of the through hole, and the adjusting wheel is received into the housing snuggly fitting into the receiving space.

12. The earphone as described in claim 10, wherein two hook portions are extended from one end of the second tube body adjacent to the second grounding contact portion, and two chambers are defined in one end of the housing, and the two hook portions are engaged with the two chambers, thus securing the two hook portions to the housing.

13. The earphone as described in claim 10, wherein a stopping block is set in one end of the main pole opposite to the first plug, the earphone further comprises a receiving conduit fixedly connected to one side of the housing away from the second tube body, and a receiving chamber is defined in the receiving conduit, and the stopping block is slidable in the receiving chamber.

14. The earphone as described in claim 13, wherein the length of the receiving chamber exceeds that of the second tube body and the longest distance of the movement of the stopping block in the receiving chamber equals to the length of the second tube body.

15. The earphone as described in claim 8, wherein the first earphone specification is 2.5 mm, and the second specification is 3.5 mm.

* * * * *